US005328763A

United States Patent [19]

Terry

[11] Patent Number: 5,328,763

[45] Date of Patent: Jul. 12, 1994

[54] SPRAY POWDER FOR HARDFACING AND PART WITH HARDFACING

[75] Inventor: Charles J. Terry, Fallon, Nev.

[73] Assignee: Kennametal Inc., Latrobe, Pa.

[21] Appl. No.: 12,709

[22] Filed: Feb. 3, 1993

[51] Int. Cl.[5] ..... B22F 1/00; B22F 7/06

[52] U.S. Cl. ..... 428/559; 428/551; 428/552; 428/564; 419/14; 419/18

[58] Field of Search ..... 75/236, 240, 243; 419/18, 14; 428/559, 551, 552, 559, 564

[56] References Cited

U.S. PATENT DOCUMENTS

| | | | |
|---|---|---|---|
| 2,714,563 | 8/1955 | Poorman et al. | 117/105 |
| 2,858,411 | 10/1958 | Gage | 219/715 |
| 2,950,867 | 8/1960 | Hawley | 239/13 |
| 3,016,447 | 1/1962 | Gage et al. | 219/76 |
| 3,190,560 | 6/1965 | Schilling et al. | 239/85 |
| 3,713,788 | 1/1973 | Prill et al. | 29/182.7 |
| 3,725,017 | 4/1973 | Prasse et al. | 29/196 G |
| 3,878,592 | 4/1975 | Humenik, Jr. et al. | 29/95 D |
| 3,909,241 | 9/1975 | Cheney et al. | 75/0.5 BB |
| 3,916,497 | 11/1975 | Doi et al. | 29/182.8 |
| 4,013,453 | 3/1977 | Patel | 75/0.5 R |
| 4,025,334 | 5/1977 | Cheney et al. | 75/0.5 R |
| 4,064,608 | 12/1977 | Jaeger | 29/132 |
| 4,124,737 | 11/1978 | Wolfla et al. | 428/640 |
| 4,328,925 | 5/1982 | Shapiro | 233/7 |
| 4,414,029 | 11/1983 | Newman et al. | 75/252 |
| 4,446,196 | 5/1984 | Brown | 428/544 |
| 4,466,829 | 8/1984 | Nishigaki et al. | 75/240 |
| 4,487,630 | 12/1984 | Crook et al. | 75/123 B |
| 4,497,660 | 2/1985 | Lindholm | 75/240 |
| 4,526,618 | 7/1985 | Keshavan et al. | 106/1.05 |
| 4,639,352 | 1/1987 | Kodama et al. | 419/15 |
| 4,666,797 | 5/1987 | Newman et al. | 428/681 |
| 4,822,415 | 4/1989 | Dorfman et al. | 75/251 |
| 4,923,511 | 5/1990 | Krizan et al. | 75/252 |
| 4,996,114 | 2/1991 | Darrow | 428/610 |
| 5,043,548 | 8/1991 | Whitney et al. | 219/121.47 |
| 5,057,147 | 10/1991 | Shaffer et al. | 75/252 |

OTHER PUBLICATIONS

Woldman's Engineering Alloys, ASM International Materials Park, Ohio (1990), 7th Ed. p. 564.

*Primary Examiner*—Donald P. Walsh
*Assistant Examiner*—John N. Greaves
*Attorney, Agent, or Firm*—John J. Prizzi

[57] ABSTRACT

A spray powder for thermal spraying onto a substrate to provide a hardfacing, and a part with such hardfacing on the surface thereof, that is corrosion-resistant and abrasion-resistant. The spray powder comprises between about 75 to about 90 weight percent of tungsten carbide. The powder further comprises between about 10 and 25 weight percent of a nickel-based alloy, which includes Mo, and optionally, includes one or more of Fe, C, Cr, Mn, Co, Si and W.

20 Claims, No Drawings

SPRAY POWDER FOR HARDFACING AND PART WITH HARDFACING

BACKGROUND OF THE INVENTION

The invention pertains to a spray powder which is sprayed, such as by thermal spraying techniques, onto the surface of the substrate to form a hardfacing on the substrate surface, as well as a part having such hardfacing thereon. More specifically, the invention pertains to the aforementioned spray powder which has excellent abrasion-resistant properties and excellent corrosion-resistant properties, as well as a part with such hardfacing thereon thereby having excellent abrasion-resistant properties and excellent corrosion-resistant properties.

Heretofore, spray powders have been used to form hardfacing on the surface of a substrate, such as a part, so as to protect the substrate from abrasion and corrosion. For example, Kennametal Inc., of Latrobe, Pa. (assignee of the present application) has heretofore made and sold a tungsten carbide-cobalt-chromium spray powder which produces a layer on a substrate with abrasion resistance and corrosion resistance.

The patent literature contains a number of patents which concern hardfacing alloys. For example, U.S. Pat. No. 4,013,453, to Patel, concerns a tungsten carbide-nickel powder hardfacing alloy. The alloy starts with two basic components; namely, a WC-Ni mixture and a nickel alloy (2.5-20% Cr, 0.5-6% Si, 0.5-5% B, up to 10% Fe, and the balance Ni). In the final alloy, the average WC content is between 10 to 30%. U.S. Pat. No. 4,526,618, to Keshavan et al., concerns an abrasion-resistant spray coating comprising (1) 78 to 88 wt % tungsten carbide, and (2) an alloy with 6-18% boron, 0-6% Si, 0-20% Cr, 0-5% Fe and the balance nickel. U.S. Pat. No. 3,725,017, to Prasse et al., concerns a hardfacing comprising a boronhardened tungsten phase in a matrix of nickel-chromium or nickel-aluminum. The '017 patent discloses the use of powders of tungsten carbide, boron and at least one alloying element (one or more of Co, Ni, Cr and A1) to produce the boron-hardened tungsten phase. U.S. Pat. No. 4,996,114, to Darrow, concerns a coating process and the resultant coating. The process comprises two basic steps. For the first step, one applies a coating of a binder (Co or Ni) and carbide grit to the surface of the substrate. The second step comprises carbiding, nitriding or boriding the surface so as to harden the surface of the binder without affecting the carbides. U.S. Pat. No. 4,124,737, to Wolfa et al., concerns a high temperature wear resistant coating comprising a Co-based alloy containing 17-35% Cr, 5-20% Ta, 0-2% Y, 0.25% Si, 0-3.0% Mn, 0.5-3.5% C, 0-14% A1 and 0-50% of at least one metal oxide (such as alumina). U.S. Pat. No. 4,414,029, to Newman et al., concerns a welding rod filler of macrocrystalline WC along with niobium alone or in combination molybdenum for use as a hardfacing.

While earlier spray powders have provided some degree of abrasion resistance and corrosion resistance, there has been a need to provide a spray powder with excellent abrasion-resistant properties in combination with excellent corrosion-resistant properties. Typical parts which require surface layers with excellent abrasion-resistant and excellent corrosion-resistant properties include the wetted parts in a chemical processing slurry pump which experience wear. Other typical parts include downhole drilling parts which experience wear and are in contact with "sour gas," i e. hydrogen sulfide.

The patent literature contains patents which disclose hardfacing layers which are supposed to provide corrosion-resistant properties. For example, U.S. Pat. No. 4,064,608, to Jaeqer, concerns a ferrous roll with a hardfacing alloy that is supposed to be heat, corrosion and wear resistant. The alloy may be nickel-base, iron-base or cobalt-base and include 0.5-5% B, 0.5-6% Si, and up to 3% carbon along with carbide formers such as W, Cr and Mo. U.S. Pat. No. 4,822,415, to Dorfman et al., concerns an iron-based thermal spray powder. According to the '415 patent, the goal of the powder is to provide an alloy with corrosion resistance, frictional wear resistance and abrasive wear resistance. The composition comprises 0-40% Cr, 1-40% Mo, 1-15% Cu, 0.2-5% B, 0-5% Si, 0.01-2% C, and the balance impurities with at least 30% Fe. The spray alloy does not contain WC.

Even though earlier patents mention corrosion-resistant hardfacing alloys, there remains the need to provide a spray powder for application as a hardfacing which has excellent abrasion-resistant properties and excellent corrosion-resistant properties.

SUMMARY OF THE INVENTION

It is the primary object of the invention to provide a spray powder for application as a hardfacing which has excellent abrasion-resistant properties and excellent corrosion-resistant properties.

It is another object of the invention to provide a part on the surface of which there is a hardfacing so as to provide the part with excellent abrasion-resistant and corrosion-resistant properties.

In one form thereof, the invention is a sintered spray powder for application as a corrosion-resistant hardfacing on a substrate comprising the following constituents: WC in an amount between about 75 and about 90 weight percent of the sintered powder; Mo in an amount of between about 1.6 and about 7.5 weight percent of the sintered powder; Fe in an amount of between 0 and about 2 weight percent of the sintered powder; C, other than C combined in WC, in an amount of between 0 and about 0.03 weight percent of the sintered powder; Cr in an amount of between 0 and about 4.4 weight percent of the sintered powder; Mn in an amount of between 0 and about 0.25 weight percent of the sintered powder; Co in an amount of between 0 and about 0.63 weight percent of the sintered powder; Si in an amount of between 0 and about 0.25 weight percent of the sintered powder; W, other than W combined in WC, in an amount of between 0 and about 1.4 weight percent of the sintered powder; and the balance nickel, wherein at least about 3.4 weight percent of the sintered powder is nickel.

In another form thereof, the invention is a sintered spray powder comprising the following constituents: about 80 weight percent of tungsten carbide; between about 3.2 and about 6 weight percent Mo; between 0 and about 1.6 weight percent Fe; between 0 and about 0.0024 weight percent C, other than C combined in WC; between 0 and about 3.5 weight percent Cr; between 0 and about 0.2 weight percent manganese; between 0 and about 0.5 weight percent cobalt; between 0 and about 0.2 weight percent Si; between 0 and about 1.06 weight percent tungsten metal, other than tungsten combined in WC; and the balance nickel, wherein at least about 6.8 weight percent of the powder is nickel.

In still another form, the invention is a sintered spray powder comprising the following constituents: about 88 weight percent of tungsten carbide; between about 1.9 and about 3.6 weight percent Mo; between 0 and about 1 weight percent Fe; between 0 and about 0.015 weight percent C, other than C combined in WC; between about 0 and about 2.1 weight percent Cr; between 0 and about 0.12 weight percent manganese; between 0 and about 0.3 weight percent cobalt; between 0 and about 0.12 weight percent Si; between 0 and about 0.64 weight percent tungsten metal, other than tungsten combined in WC; and the balance nickel, wherein at least about 4.1 weight percent of the powder is nickel.

In still another form thereof, the invention is a part having a surface with hardfacing thereon, the hardfacing comprising: WC in an amount between about 75 and about 90 weight percent; Mo in an amount of between about 1.6 and about 7.5 weight percent; Fe in an amount of between 0 and about 2 weight percent; C, other than C combined in WC, in an amount of between 0 and about 0.03 weight percent; Cr in an amount of between 0 and about 4.4 weight percent; Mn in an amount of between 0 and about 0.25 weight percent; Co in an amount of between 0 and about 0.63 weight percent; Si in an amount of between 0 and about 0.25 weight percent; W, other than W combined in WC, in an amount of between 0 and about 1.4 weight percent; and the balance nickel, wherein at least about 3.4 weight percent is nickel.

DETAILED DESCRIPTION OF SPECIFIC EMBODIMENTS

The invention pertains to a spray powder for application as a hardfacing that presents excellent corrosion-resistant properties and excellent abrasion-resistant properties. The invention also pertains to an article of manufacture, such as a wear part or the like, that could be subject to abrasive and corrosive conditions and which includes a surface with the hardfacing applied thereon. The combination of these properties becomes important for articles such as wear parts that operate in a corrosive environment.

Typical parts which require both abrasion-resistant and corrosion-resistant surface layers include the wetted parts in a chemical processing slurry pump which experience wear. Other typical parts include downhole drilling parts which experience wear and are in contact with corrosive brine or "sour gas," i.e., hydrogen sulfide, which has a corrosive action on the parts.

In addition to the above articles, the hardfacing could be applied to centrifugal pump shaft bearing surfaces, pump liners, mud pump valve seats, coal slurry pump valve seats, bearing surfaces on impellers in centrifugal pumps, radial shaft support surfaces in centrifugal pumps, thrust areas in centrifugal pumps, the clapper of a check valve in valve seats, crude pipeline, pump impellers, mixing impellers for mixing and blending slurries, gate valves and various valve components, liners for pistons in drilling pumps, tool joints and casing for downhole drilling, directional bits and drill motors, impeller stages in elevated submersible pumps, down hole hydraulic jet pump throats, refractory/ceramic liners to vessels and pipelines for petrochemicals, cutterfacings or composite rods for junk mills, and injection nozzles.

The hardfacing is applied via plasma or HVOF (high velocity oxygen fuel) spraying techniques. The following patents discuss flame spraying techniques that may be suitable for use with the spray powder of the present invention: U.S. Pat. Nos. 2,714,563; 2,858,411; 2,950,867; 3,016,447 and 3,190,560.

The present invention comprises the sintered product of a combination of a wear-resistant tungsten carbide and a corrosion-resistant nickel-based alloy. The specific tungsten carbide in the examples is available from Kennametal Inc. of Latrobe, Pa., USA, as the traditional APT-based tungsten carbide. However, the present scope of the invention encompasses macrocrystalline tungsten carbide available from Kennametal Inc., of Latrobe, Pa.

The specific nickel-based alloy is NISTELLE C powder, available from the Stellite Division of Haynes International, Inc. The NISTELLE C has a composition of 16–18 wt % Mo; 13–17.5 wt % Cr; 3.7–5.3 wt % W; 4.5–7 wt % Fe; and the balance Ni. However, applicant intends the scope of the invention to be broader than the use of these specific alloys.

Applicant has found that a combination of tungsten carbide and the nickel-based alloy produces a spray powder useful for hardfacing that produces a hardfacing with excellent corrosion-resistant and abrasion-resistant properties. In regard to one specific embodiment of the spray powder, about 80 weight percent traditional APT-based tungsten carbide (available from Kennametal Inc., of Latrobe, Pa.) and about 20 weight percent NISTELLE C powder (available from the Stellite Division of Haynes International, Inc.) were rod milled to a particle size of about 1.5 microns. This powder was lubed with a pressing lubricant, then pelletized, and then sintered at 2515° F. for 30 minutes. The sintered product was then crushed, milled and classified to a 30×15 micron powder suitable for spray powder applications.

Although some of the tables below reflect data for the specific composition of 80 weight percent tungsten carbide and 20 weight NISTELLE C, applicant considers the scope of the invention to be broader than the 80/20 weight ratio of WC/nickel-based alloy. The tungsten carbide component may range between about 75 wt % and about 90 wt % and the nickel-based alloy component may range between about 10 wt % and about 25 wt % of the spray powder.

Furthermore, applicant contemplates that other compositions of nickel-based alloys would be satisfactory to use in the present invention. These compositions include HASTELLOY C, available through Haynes International, Inc., having a composition of 17 wt % Cr; 0.1 wt % C; 17 wt % Mo; 6 wt % Fe; 5 wt % W and balance Ni; HASTELLOY C, available through Teledyne Rodney Metals, having a composition of 16–18 wt % Mo; 13–17.5 wt % Cr; 3.7–5.3 wt % W; 4.5–7 wt % Fe; and balance Ni; and HASTELLOY C, available through Haynes International Inc., having a composition of 0–0.12 wt % C; 16.5 wt % Cr; 17 wt % Mo; 5.5 wt % Fe; 0–2.5 wt % Co; 4.5 wt % W; 0–1 wt % Si; 0–1 wt % Mn; and balance Ni.

Applicant further contemplates the use of the following nickel-based alloys: HASTELLOY B, available from Langley Alloys Ltd. or Teledyne Rodney Metals, having a composition of 26–30 wt % Mo; 4–6 wt % Fe; 0–0.12 wt % C; and 62 wt % Ni; HASTELLOY B-2, available from Haynes International Inc., having a composition of 0–0.01 wt % C; 26–30 wt % Mo; 0–2 wt % Fe; 0–1 wt % Cr; 0–1 wt % Mn; 0–1 wt % Co; 0–0.1 wt % Si; and the balance Ni.

Thus, the invention is of such a scope so as to include a spray powder for application as a corrosion-resistant hardfacing on a substrate. The spray powder comprises between about 75 weight percent and about 90 weight percent of tungsten carbide and between about 10 weight percent and about 25 weight percent of a nickel-based alloy.

In the examples, the WC is the traditional APT-based tungsten carbide; however, applicant considers the present scope of the invention to encompass WC including macrocrystalline WC. The nickel-based alloy can comprise the following ranges of elements: Mo in an amount of between about 16 to about 30 weight percent of the alloy; Fe in an amount of between about 0 to about 8 weight percent of the alloy; C in an amount of between about 0 to about 0.12 weight percent of the alloy; Cr in an amount of between about 0 to about 17.5 weight percent of the alloy; Mn in an amount of between about 0 to about 1 weight percent of the alloy; Co in an amount of between about 0 to about 2.5 weight percent of the alloy; Si in an amount of between about 0 to about 1 weight percent of the alloy; W in an amount of between 0 to about 5.3 weight percent of the alloy; and nickel being the balance of the nickel-based alloy.

EXAMPLES

The following examples demonstrate the superior results obtained by one specific embodiment of the invention as compared to the Kennametal tungsten carbide-cobalt-chromium alloy alone. The Kennametal tungsten carbide-cobalt-chromium alloy (which is called WC/Co/Cr) is the sintered product from a powder mixture of 80.8 wt % macrocrystalline tungsten carbide, 5.0 wt % tungsten metal powder, 4.0 wt % chromium metal powder, and 10.2 wt % cobalt metal powder. The chemical properties of this alloy are:

| Element | Content (wt %) min./max. |
|---|---|
| carbon | 5.0/5.5 |
| cobalt | 9.5/10.5 |
| chromium | 3 5/4.5 |
| iron | 0.4 maximum |
| tungsten | balance |

In order to test the corrosion resistance of the hardfacing, sintered pellets of the above-discussed specific embodiment of the invention (i.e., 80 weight percent tungsten carbide and 20 weight percent NISTELLE C) were tested in solutions of various concentrations of hydrochloric acid, sulfuric acid and nitric acid. The basic methodology is described below.

Sintered pellets of the specific embodiment, having a size between about ⅜ to ½ inch in diameter, were used as the samples. Each pellet was weighed, and then submerged in its respective acid solution. The solution was kept at 75° F.

At regular intervals, each pllet was removed from the solution, water washed, oven dried for one hour, and weighed before being resubmerged into the same acid solution. The results for the corrosion testing of the one specific embodiment of the invention are set forth below in Tables I through VI. Tables I, III and V show the weight of each sample taken at the start and at 5, 9, 15, 20 26 (in Tables I and III), 33 and 40 days into the test.

TABLE I

Corrosion Testing by Days for 20% Alloy Powder in HCl

| Sample | 0 | 5 | 9 | 15 |
|---|---|---|---|---|
| 1 | 4.2555 | 4.2475 | 4.2425 | 4.2327 |
| 2 | 7.8396 | 7.8346 | 7.8290 | 7.8159 |
| 3 | 6.1194 | 6.1154 | 6.1119 | 6.1059 |
| **Sample** | **20** | **26** | **33** | **40** |
| 1 | 4.2203 | 4.1968 | 4.1616 | 4.1156 |
| 2 | 7.8013 | 7.7751 | 7.7423 | 7.7037 |
| 3 | 6.0946 | 6.0858 | 6.0763 | 6.0623 |

Note: Sample 1 was 100% HCl. Sample 2 was 50 volume % HCL. Sample 3 was 25 volume % HCl. The unit of measurement for the weight of each sample is grams.

TABLE II

20% Alloy in HCl
Percent Loss by Days from Original Weight

| Sample | 0 | 5 | 9 | 15 |
|---|---|---|---|---|
| 1 | — | 0.19% | 0.31% | 0.54% |
| 2 | — | 0.06% | 0.14% | 0.30% |
| 3 | — | 0.07% | 0.12% | 0.22% |
| **Sample** | **20** | **26** | **33** | **40** |
| 1 | 0.83% | 1.38% | 2.21% | 3.29% |
| 2 | 0.49% | 0.82% | 1.24% | 1.73% |
| 3 | 0.41% | 0.55% | 0.70% | 0.93% |

TABLE III

Corrosion Testing by
Days for 20% Alloy Powder in $H_2SO_4$

| Sample | 0 | 5 | 9 | 15 |
|---|---|---|---|---|
| 4 | 5.7296 | 5.7290 | 5.7278 | 5.7278 |
| 5 | 7.1821 | 7.1727 | 7.1688 | 7.1650 |
| 6 | 7.7931 | 7.7827 | 7.7760 | 7.7737 |
| **Sample** | **20** | **26** | **33** | **40** |
| 4 | 5.7134 | 5.7126 | 5.7112 | 5.7108 |
| 5 | 7.1631 | 7.1620 | 7.1608 | 7.1607 |
| 6 | 7.7638 | 7.7590 | 7.7543 | 7.7522 |

Note: Sample 4 was 100% $H_2SO_4$. Sample 5 was 50% $H_2SO_4$. Sample 6 was 25% $H_2SO_4$. The unit of meaasurement for the weight of each sample is grams.

TABLE IV

20% Alloy in $H_2SO_4$ Percent
Loss by Days from Original Weight

| Sample | 0 | 5 | 9 | 15 |
|---|---|---|---|---|
| 4 | — | 0.01% | 0.02% | 0.03% |
| 5 | — | 0.13% | 0.19% | 0.24% |
| 6 | — | 0.13% | 0.22% | 0.25% |
| **Sample** | **20** | **26** | **33** | **40** |
| 4 | 0.28% | 0.30% | 0.32% | 0.33% |
| 5 | 0.26% | 0.28% | 0.30% | 0.30% |
| 6 | 0.38% | 0.44% | 0.50% | 0.52% |

TABLE V

Corrosion Testing by
Days for 20% Alloy Powder in $HNO_3$

| Sample | 0 | 5 | 9 | 15 | 33 | 40 |
|---|---|---|---|---|---|---|
| 7 | 6.0478 | 6.0478 | 6.0477 | 6.0477 | 6.0477 | 6.0477 |
| 8 | 7.7395 | 7.7326 | 7.7259 | 7.7259 | 7.7259 | 7.7259 |
| 9 | 7.1601 | 7.1601 | 7.1601 | 7.1601 | 7.1601 | 7.1601 |

Note: Sample 7 is 100% $HNO_3$. Sample 8 is 50% $HNO_3$. Sample 9 is 25% $HNO_3$. The unit of measurement for weight of each sample is grams.

TABLE VI

| 20% Alloy in $HNO_3$ Percent Loss by Days from Original Weight | | | | | |
|---|---|---|---|---|---|
| Sample 0 | 5 | 9 | 15 | 33 | 40 |
| 7 | 0% | 0.00% | 0.00% | 0.00% | 0.00% |
| 8 | 0.09% | 0.18% | 0.18% | 0.18% | 0.18% |
| 9 | 0.00% | 0.00% | 0.00% | 0.00% | 0.00% |

As a comparison, pellets of the WC/Co/Cr spray powder (the Kennametal tungsten carbide-cobalt-chromium powder previously described) were tested at selected intervals for corrosion resistance in various concentrations of hydrochloric acid, sulfuric acid, and nitric acid. The results are set out in Tables VII to XII below. Tables VII, IX and XI show the weight of each sample at selected days into the test. Tables VIII, X and XII show the percent loss from the original weight at selected days into the test.

TABLE VII

| Corrosion Testing for WC/Co/Cr In HCl | | | | |
|---|---|---|---|---|
| Sample | 0 | 5 | 9 | 15 |
| 1 | 3.7275 | 3.7163 | 3.7054 | 3.6847 |
| 2 | 5.1036 | 5.0582 | 5.0435 | 5.0082 |
| 3 | 4.7165 | 4.6951 | 4.6722 | 4.6334 |
| Sample | 20 | 26 | 40 | |
| 1 | 3.6628 | 3.6407 | 3.5439 | |
| 2 | 4.9633 | 4.9213 | 4.7820 | |
| 3 | 4.5944 | 4.5552 | 4.4805 | |

Note: Sample 1 was tested in 100% HCl. Sample 2 was tested in 50% HCl. Sample 3 was tested in 25% HCl. The unit of measurement for the weight of each sample is grams.

TABLE VIII

| WC/Co/Cr in HCl Percent Percent Loss in Days from Original Weight | | | | |
|---|---|---|---|---|
| Sample | 5 | 9 | 15 | 20 |
| 1 | 0.30% | 0.59% | 1.15% | 1.74% |
| 2 | 0.89% | 1.18% | 1.87% | 2.75% |
| 3 | 0.45% | 0.94% | 1.76% | 2.59% |
| Sample | 26 | 33 | 40 | |
| 1 | 2.33% | 3.84% | 4.93% | |
| 2 | 3.57% | 4.90% | 6.30% | |
| 3 | 3.42% | 4.15% | 5.00% | |

TABLE IX

| Corrosion Testing by Days of WC/Co/Cr in $H_2SO_4$ | | | | |
|---|---|---|---|---|
| Sample | 0 | 5 | 9 | 15 |
| 4 | 4.1577 | 4.1568 | 4.1566 | 4.1557 |
| 5 | 8.8116 | 8.7882 | 8.7550 | 8.7206 |
| 6 | 9.6663 | 9.5527 | 9.4549 | 9.3891 |
| Sample | 20 | 26 | 40 | |
| 4 | 4.1544 | 4.1527 | 4.1518 | |
| 5 | 8.6752 | 8.6304 | 8.6277 | |
| 6 | 9.3017 | 9.2264 | 9.1722 | |

Note: Sample 4 was tested in 100% $H_2SO_4$. Sample 5 was tested in 50% $H_2SO_4$. Sample 6 was tested in 25% $H_2SO_4$. The unit of measurement for the weight of each sample is grams.

TABLE X

| WC/Co/Cr in $H_2SO_4$ Percent Loss by Days from Original Weight | | | | |
|---|---|---|---|---|
| Sample | 0 | 5 | 9 | 15 |
| 4 | — | 0.02% | 0.03% | 0.05% |
| 5 | — | 0.27% | 0.64% | 1.03% |
| 6 | — | 1.18% | 2.19% | 2.87% |

TABLE X-continued

| WC/Co/Cr in $H_2SO_4$ Percent Loss by Days from Original Weight | | | | |
|---|---|---|---|---|
| Sample | 20 | 26 | 33 | 40 |
| 4 | 0.08% | 0.12% | 0.13% | 0.14% |
| 5 | 1.55% | 2.06% | 2.07% | 2.09% |
| 6 | 3.77% | 4.55% | 4.82% | 5.11% |

TABLE XI

| Corrosion Testing by Days of WC/Co/Cr Alloy in $HNO_3$ | | | | |
|---|---|---|---|---|
| Sample | 0 | 5 | 9 | 15 |
| 7 | 3.9171 | 3.8767 | 3.8364 | 3.8328 |
| 8 | 3.4296 | 3.3992 | 3.3696 | 3.3634 |
| 9 | 3.4058 | 3.3746 | 3.3431 | 3.3425 |
| Sample | 20 | 26 | 33 | 40 |
| 7 | 3.8297 | 3.8254 | 3.821 | 3.8113 |
| 8 | 3.3586 | 3.3481 | 3.3432 | 3.3325 |
| 9 | 3.3421 | 3.3421 | 3.3421 | 3.3421 |

Note: Sample 7 was tested in 100% $HNO_3$. Sample 8 was tested in 50% $HNO_3$. Sample 9 was tested in 25% $HNO_3$. The unit of measurement for the weight of each sample is grams.

TABLE XII

| WC/Co/Cr Alloy in $HNO_3$ Percent Loss by Days from Original Weight | | | | |
|---|---|---|---|---|
| Sample | 0 | 5 | 9 | 15 |
| 7 | — | 1.03% | 2.06% | 2.15% |
| 8 | — | 0.89% | 1.75% | 1.93% |
| 9 | — | 0.92% | 1.84% | 1.86% |
| Sample | 20 | 26 | 33 | 40 |
| 7 | 2.23% | 2.34% | 2.45% | 2.70% |
| 8 | 2.07% | 2.38% | 2.52% | 2.83% |
| 9 | 1.87% | 1.87% | 1.87% | 1.87% |

TABLE XIII

| Comparison of WC/Co/Cr and Alloy of the Invention in HCl | | | |
|---|---|---|---|
| Concentration | Days | WC/Co/Cr | Invention |
| 100% | 5 | .30 | 0.19 |
| 100% | 20 | 1.74 | 0.83 |
| 100% | 40 | 4.93 | 3.29 |
| 50% | 5 | 0.89 | 0.06 |
| 50% | 20 | 2.75 | 0.49 |
| 50% | 40 | 6.30 | 1.73 |
| 25 | 5 | 0.45 | 0.07 |
| 25 | 20 | 2.59 | 0.41 |
| 25 | 40 | 5.00 | 0.93 |

Table XIV compares the weight loss of the WC/Co/Cr alloy with the invention in sulfuric acid.

TABLE XIV

| Comparison of WC/Co/Cr Alloy and Alloy of the Invention in $H_2SO_4$ | | | |
|---|---|---|---|
| Concentration | Days | WC/Co/Cr | Invention |
| 100 | 5 | 0.02 | 0.01 |
| 100 | 20 | 0.08 | 0.28 |
| 100 | 40 | 0.14 | 0.33 |
| 50 | 5 | 0.27 | 0.13 |
| 50 | 20 | 1.55 | 0.26 |
| 50 | 40 | 2.09 | 0.30 |
| 25 | 5 | 1.55 | 0.13 |
| 25 | 20 | 3.77 | 0.38 |
| 25 | 40 | 5.11 | 0.52 |

Table XV compares the weight loss of the WC/Co/Cr alloy with the invention in nitric acid.

TABLE XV

| Comparison of WC/Co/Cr Alloy and Alloy of the Invention in $HNO_3$ | | | |
|---|---|---|---|
| Concentration | Days | WC/Co/Cr | Invention |
| 100 | 5 | 1.03 | 0.00 |
| 100 | 20 | 2.23 | 0.00 |
| 100 | 40 | 2.70 | 0.00 |
| 50 | 5 | 0.89 | 0.09 |
| 50 | 20 | 2.07 | 0.18 |
| 50 | 40 | 2.83 | 0.18 |
| 25 | 5 | 0.92 | 0.00 |
| 25 | 20 | 1.87 | 0.00 |
| 25 | 40 | 1.87 | 0.00 |

Tests were conducted to compare the abrasion-resistant properties of the invention to the Kennametal tungsten carbide-cobalt-chromium alloy. Two specific alloys of the invention were tested for abrasion resistance. One alloy comprised about 88 wt % of the traditional APT-based WC and about 12 wt % of the NISTELLE C alloy by Stellite. The other alloy comprised about 80 wt % of the traditional APT-based WC and about 20 wt % of the NISTELLE C alloy by Stellite. These tests were conducted according to ASTM B6-11 Procedure except that the test went for 50 revolutions rather than 1000 revolutions. The samples presented uniform deposits of each hardfacing with low levels of porosity. The results for the WC/Co/Cr alloy were normalized to 1.00 so that the results for the 12% alloy (88 wt % WC and 12 wt % NISTELLE C from Stellite) and 20% alloy (80 wt % WC and 20 wt % NISTELLE C from Stellite) are relative to those for the WC/Co/Cr alloy. The results are below in Table XVI.

TABLE XVI

| Material | Wear | Hardness ($R_c$) |
|---|---|---|
| WC/Co/Cr | 1.00 | 44.2 |
| 12% Alloy | .67 | 46.8 |
| 20% Alloy | .65 | 46.4 |

As can be seen, each one of the specific examples has a meaningfully better abrasion resistance than the standard WC/Co/Cr alloy. Furthermore, each one of the specific examples has a greater hardness than the standard WC/Co/Cr alloy.

Samples of the 12% alloy (88 wt % WC and 12 wt % NISTELLE C) and 20% alloy (80 wt % WC and 20 wt % NISTELLE C) applied as a hardfacing to a substrate were held at a temperature of about 1000° F. for 90 minutes. No significant oxidation was visible. It can thus be seen that the specific examples exhibit good resistance to oxidation at an elevated temperature.

The overall improvement in abrasion resistance and corrosion resistance displayed by the present invention over the WC/Co/Cr alloy is meaningful. However, this improvement becomes even more meaningful when viewed in light of recent hardfacing test results published by the University of Tulsa, Department of Mechanical Engineering, in Tulsa, Okla., in the Fall of 1992. The particular publication is Shadley, J. R., Rybicki, E., Han, W. and Greving, D., "Evaluations of Selected Thermal Spray Coatings for Oil and Gas Industry Applications," Thermal Spray Coating Research Center, The University of Tulsa, 600 South College Avenue, Tulsa, Okla. 74104-3189.

The Tulsa Report reports the results of tests for erosion, abrasion, corrosion and bond strength for a number of hardfacing materials. One of the hardfacing materials is a tungsten carbide containing Co and Cr identified as Stellite JK-120. The specific composition is 86 wt % WC, 10 wt % Co and 4 wt % Cr. Although not exactly the same, the Stellite JK-120 has some similarity to the WC/Co/Cr alloy against which applicant compared the present invention. The Stellite JK-120 applied to a 1018 steel base metal via HVOF technique by Stellite Jet Kote II equipment exhibited excellent properties in comparison to the other alloys reported in the Tulsa Report. The present invention exhibited superior corrosion-resistant and abrasion-resistant properties over the WC/Co/Cr alloy. Thus, it become apparent that applicant has provided a novel spray powder alloy that has excellent abrasion-resistance and corrosion-resistance properties. The present invention also has good resistance to oxidation at elevated temperatures.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A sintered spray powder for application as a corrosion-resistant hardfacing on a substrate, the sintered powder consisting essentially of:

WC in an amount between about 75 and about 90 weight percent of the sintered powder;

Mo in an amount of between about 1.6 and about 7.5 weight percent of the sintered powder;

Fe in an amount of between 0 and about 2 weight percent of the sintered powder;

C, other than C combined in WC, in an amount of between 0 and about 0.03 weight percent of the sintered powder;

Cr in an amount of between 0 and about 4.4 weight percent of the sintered powder;

Mn in an amount of between 0 and about 0.25 weight percent of the sintered powder;

Co in an amount of between 0 and about 0.63 weight percent of the sintered powder;

Si in an amount of between 0 and about 0.25 weight percent of the sintered powder;

W, other than W combined in WC, in an amount of between 0 and about 1.4 weight percent of the sintered powder; and the balance nickel, wherein at least about 3.4 weight percent of the sintered powder is nickel.

2. The sintered spray powder of claim 1 wherein the Mo is present in an amount between about 2.6 and about 7.5 weight percent, the Fe is present in an amount between about 0.4 and about 2 weight percent, and the nickel is present in an amount between about 6.2 and about 15.5 weight percent.

3. The sintered spray powder of claim 2 wherein the Fe is present in amount between about 0.4 and about 1.5 weight percent.

4. The sintered spray powder of claim 1 wherein the Mo is present in an amount between about 2.6 and about 7.5 weight percent; the Fe is present in an amount between 0 and about 0.5 weight percent; the C, other than combined in the WC, is present in an amount between 0 and about 0.003 weight percent; the Cr is present in an amount between 0 and about 0.25 weight percent; the Co is present in an amount between 0 and about 0.25 weight percent; the Si is present in an amount between about 0 and about 0.025 weight percent; and the nickel is present in amount between about 6.5 and about 18.5 weight percent.

5. The sintered spray powder of claim 1 wherein the W, other than W combined in the WC, is present in an amount between about 0.5 and 1.25 weight percent; the Mo is present in an amount between about 1.7 and about 4.25 weight percent; the Fe is present in an amount between about 0.6 and 1.5 weight percent; the Cr is present in an amount between about 1.7 and about 4.25 weight percent; and Ni is present in an amount between about 5.5 weight percent and about 13.8 weight percent.

6. The sintered spray powder of claim 1 wherein the W, other than W combined in the WC, is present in an amount between about 0.37 and 1.4 weight percent; the Mo is present in an amount between about 1.6 and about 4.5 weight percent; the Fe is present in an amount between about 0.4 and about 1.43 weight percent; the Cr is present in an amount between about 1.3 and about 4.4 weight percent; and Ni is present in an amount between about 5.3 and about 15.9 weight percent.

7. The spray powder of claim 1 wherein W, other than W combined in WC, is present in an amount between about 0.45 and about 1.25 weight percent; Mo is present in an amount between 1.7 and about 4.25 weight percent; Fe is present in an amount between about 0.55 and about 1.4 weight percent; Cr is present in an amount between about 1.6 to about 4.2 weight percent; Co is present in an amount between 0 and about 0.63 weight percent; and nickel is present in an amount between about 5.2 and about 14.1 weight percent.

8. A sintered spray powder consisting essentially of:
- about 80 weight percent of tungsten carbide;
- between about 3.2 and about 6 weight percent Mo;
- between 0 and about 1.6 weight percent Fe;
- between 0 and about 0.0024 weight percent C, other than C combined in WC;
- between 0 and about 3.5 weight percent Cr;
- between 0 and about 0.2 weight percent manganese;
- between 0 and about 0.5 weight percent cobalt;
- between 0 and about 0.2 weight percent Si;
- between 0 and about 1.06 weight percent tungsten metal, other than tungsten combined in WC; and
- the balance nickel wherein at least about 6.8 weight percent of the powder is nickel.

9. The spray powder of claim 8 wherein Mo in an amount of between about 3.2 and about 3.6 weight percent; Fe in an amount of between about 0.8 and about 1.2 weight percent; Cr in an amount of between about 2.6 and about 3.5 weight percent; W, other than W combined in WC, in an amount of between about 0.74 and about 1.06 weight percent; and the balance nickel wherein at least about 10.4 weight percent of the powder is nickel.

10. A sintered spray powder consisting essentially of:
- about 88 weight percent of tungsten carbide;
- between about 1.9 and about 3.6 weight percent Mo;
- between 0 and about 1 weight percent Fe;
- between 0 and about 0.015 weight percent C, other than C combined in WC;
- between 0 and about 2.1 weight percent Cr;
- between 0 and about 0.12 weight percent manganese;
- between 0 and about 0.3 weight percent cobalt;
- between 0 and about 0.12 weight percent Si;
- between 0 and about 0.64 weight percent tungsten metal, other than tungsten combined in WC; and
- and balance nickel wherein at least about 4.1 weight percent of the powder is nickel.

11. The spray powder of claim 10 wherein Mo in an amount of between about 1.9 and about 2.2 weight percent; Fe in an amount of between about 0.48 and about 0.69 weight percent; Cr in an amount of between about 1.5 and about 2.1 weight percent; W, other than W combined in WC, in an amount of between about 0.44 and about 0.64 weight percent; and the balance nickel wherein at least about 6.2 weight percent of the powder is nickel.

12. A part having a surface with hardfacing on the surface, the hardfacing consisting essentially of:
- WC in an amount between about 75 and about 90 weight percent;
- Mo in an amount of between about 1.6 and about 7.5 weight percent;
- Fe in an amount of between 0 and about 2 weight percent;
- C, other than C combined in WC, in an amount of between 0 and about 0.03 weight percent;
- Cr in an amount of between 0 and about 4.4 weight percent;
- Mn in an amount of between 0 and about 0.25 weight percent;
- Co in an amount of between 0 and about 0.63 weight percent;
- Si in an amount of between 0 and about 0.25 weight percent;
- W, other than W combined in WC, in an amount of between 0 and about 1.4 weight percent; and
- the balance nickel, wherein at least about 3.4 weight percent is nickel.

13. The part of claim 12 wherein in the hardfacing the Mo is present in an amount between about 2.6 and about 7.5 weight percent, the Fe is present in an amount between about 0.4 and about 2 weight percent, and the nickel is present in an amount between about 6.2 and about 15.5 weight percent.

14. The part of claim 13 wherein in the hardfacing the Fe is present in amount between about 0.4 and about 1.5 weight percent.

15. The part of claim 12 wherein in the hardfacing the Mo is present in an amount between about 2.6 and about 7.5 weight percent; the Fe is present in an amount between 0 and about 0.5 weight percent; the C, other than combined in the WC, is present in an amount between 0 and about 0.003 weight percent; the Cr is present in an amount between 0 and about 0.25 weight percent; the Co is present in an amount between 0 and about 0.25 weight percent; the Si is present in an amount between 0 and about 0.025 weight percent; and the nickel is present in amount between about 6.5 and about 18.5 weight percent.

16. The part of claim 12 wherein in the hardfacing the W, other than W combined in the WC, is present in an amount between about 0.5 and 1.25 weight percent; the Mo is present in an amount between about 1.7 and about 4.25 weight percent; the Fe is present in an amount between about 0.6 and 1.5 weight percent; the Cr is present in an amount between about 1.7 and about 4.25 weight percent; and Ni is present in an amount between about 5.5 weight percent and about 13.8 weight percent.

17. The part of claim 12 wherein in the hardfacing the W, other than W combined in the WC, is present in an amount between about 0.37 and 1.4 weight percent; the Mo is present in an amount between about 1.6 and about 4.5 weight percent; the Fe is present in an amount between about 0.4 and about 1.43 weight percent; the Cr is present in an amount between about 1.3 and about 4.4 weight percent; and Ni is present in an amount between about 5.3 and about 15.9 weight percent.

18. The part of claim 12 wherein in the hardfacing W, other than W combined in WC, is present in an amount between about 0.45 and about 1.25 weight percent; Mo is present in an amount between 1.7 and about 4.25 weight percent; Fe is present in an amount between about 0.55 and about 1.4 weight percent; Cr is present in an amount between about 1.6 to about 4.2 weight percent; Co is present in an amount between 0 and about 0.63 weight percent; and nickel is present in an amount between about 5.2 and about 14.1 weight percent.

19. The part of claim 12 wherein the hardfacing comprises: about 80 weight percent of tungsten carbide; between about 3.2 and about 6 weight percent Mo; between 0 and about 1.6 weight percent Fe; between 0 and about 0.0024 weight percent C, other than C combined in WC; between 0 and about 3.5 weight percent Cr; between 0 and about 0.2 weight percent manganese; between 0 and about 0.5 weight percent cobalt; between 0 and about 0.2 weight percent Si; between 0 and about 1.06 weight percent tungsten metal, other than tungsten combined in WC; and the balance nickel wherein at least about 6.8 weight percent of the powder is nickel.

20. The part of claim 12 wherein the hardfacing comprises: about 88 weight percent WC; between about 1.9 and about 3.6 weight percent Mo; between 0 and about 1 weight percent Fe; between 0 and about 0.015 weight percent C, other than C combined in WC; between 0 and about 2.1 weight percent Cr; between 0 and about 0.12 weight percent manganese; between 0 and about 0.3 weight percent cobalt; between 0 and about 0.12 weight percent Si; between 0 and about 0.64 weight percent tungsten metal, other than tungsten combined in WC; and balance nickel wherein at least about 4.1 weight percent of the powder is nickel.

* * * * *